US009571916B2

(12) United States Patent
Hsu et al.

(10) Patent No.: US 9,571,916 B2
(45) Date of Patent: Feb. 14, 2017

(54) AUDIO CODEC WITH AUDIO JACK DETECTION FUNCTION AND AUDIO JACK DETECTION METHOD

(71) Applicant: REALTEK SEMICONDUCTOR CORPORATION, Hsinchu (TW)

(72) Inventors: Yuan-Ping Hsu, Hsinchu (TW); Cheng-Pin Chang, Taipei (TW)

(73) Assignee: Realtek Semiconductor Corporation, Hsinchu (TW)

( * ) Notice: Subject to any disclaimer, the term of this patent is extended or adjusted under 35 U.S.C. 154(b) by 238 days.

(21) Appl. No.: 14/496,684

(22) Filed: Sep. 25, 2014

(65) Prior Publication Data

US 2015/0117663 A1 Apr. 30, 2015

(30) Foreign Application Priority Data

Oct. 29, 2013 (TW) ..... 102139048 A

(51) Int. Cl.
*H04R 1/10* (2006.01)

(52) U.S. Cl.
CPC ..... *H04R 1/1041* (2013.01); *H04R 2420/05* (2013.01)

(58) Field of Classification Search
CPC ..... H04R 1/1041
USPC ..... 381/74, 384
See application file for complete search history.

(56) References Cited

U.S. PATENT DOCUMENTS

2008/0130911 A1 6/2008 Tsen
2008/0307144 A1* 12/2008 Minoo ..... G06F 1/1632 710/304
2014/0100001 A1* 4/2014 Im ..... H04M 1/6058 455/570
2014/0380103 A1* 12/2014 Peng ..... G06F 13/00 714/43

FOREIGN PATENT DOCUMENTS

TW 200826718 A 6/2008

OTHER PUBLICATIONS

Taiwan Office Action issued on Nov. 13, 2015 for counterpart Taiwan application No. 102139048.

(Continued)

*Primary Examiner* — Paul S Kim
*Assistant Examiner* — Katherine Faley
(74) *Attorney, Agent, or Firm* — WPAT, P.C., Intellectual Property Attorneys; Anthony King

(57) ABSTRACT

The present invention discloses an audio codec with a jack detection function and an audio jack detection method. An embodiment of the audio codec comprises: a first-contact signal input end operable to electrically connect with a sleeve contact of a plug and receive a first-contact signal indicating the presence or absence of the plug; a second-contact signal input end operable to electrically connect with a ring contact or the sleeve contact of the plug and receive a second-contact signal indicating the presence or absence of the plug; a plug detecting circuit coupled to the first-contact or second-contact signal input end and operable to detect whether a voltage level of the first-contact or second-contact signal has changed to thereby generate a plug detection signal; and a control circuit coupled to the plug detecting circuit and operable to determine the presence or absence of the plug according to the plug detection signal.

16 Claims, 6 Drawing Sheets

(56) References Cited

OTHER PUBLICATIONS

The Search Report corresponding to the Nov. 13, 2015 Taiwan Office Action for counterpart Taiwan application No. 102139048. Translation of relevant portion.

* cited by examiner

AUDIO CODEC WITH AUDIO JACK DETECTION FUNCTION AND AUDIO JACK DETECTION METHOD

BACKGROUND OF THE INVENTION

1. Field of the Invention

The present invention relates to an audio codec with an audio jack detection function and an audio jack detection method, especially to an audio codec and an audio jack detection method executing detection through an existing/common pin instead of an additional/dedicated pin.

2. Description of Related Art

Generally speaking, an electronic device with an audio function is equipped with an earphone jack and/or a microphone jack for users to insert an earphone and/or a microphone into the electronic device. Some electronic device is only equipped with one of the earphone and microphone jacks; some is equipped with both of them; and some is equipped with a composite jack for a headset including the functions of earphone and microphone to connect. No matter what kind of the electronic device is, it needs to detect whether an earphone, a microphone or a multi-function headset is inserted or detached, so as to react in response to the detection result. The existing jack detection technique sets an independent detecting mechanism on a circuit board where an audio codec (coder/decoder) is set as well, then detects whether a plug is inserted or removed by the detecting mechanism, afterwards transmits the detection result to the audio codec through the pin thereof dedicated to the detection, and finally has the audio codec determine the presence or absence of the plug in accordance with the detection result. However, this manner has to set a detecting mechanism outside the audio codec and consequently consume a pin of the audio codec; therefore it is unfavorable to the cost and size of an audio codec solution.

In light of the above, the current audio jack detection technique is obviously not good enough, which means that this technique field needs a cost-effective solution to realize the audio jack detection.

People who are interested in the prior arts may refer to the Taiwan (R.O.C.) patents by the following patent numbers: I236191; I358862; M383236.

SUMMARY OF THE INVENTION

An object of the present invention is to provide an audio codec with an audio jack detection function and an audio jack detection method to improve the prior art.

Another object of the present invention is to provide an audio codec with an audio jack detection function and an audio jack detection method to save the codec an additional pin and the cost thereof.

A further object of the present invention is to provide an audio codec with an audio jack detection function and an audio jack detection method to carry out jack detection inside the audio codec and thereby eliminate the demand of using some mechanical detecting device outside the codec.

The present invention discloses an audio codec with an audio jack detection function capable of detecting the presence or absence of a plug. An embodiment of the audio codec comprises: a first-contact signal input end operable to electrically connect with a sleeve contact of a plug and receive a first-contact signal indicating the presence or absence of the plug; a second-contact signal input end operable to electrically connect with a ring contact or the sleeve contact of the plug and receive a second-contact signal indicating the presence or absence of the plug; a plug detecting circuit operable to detect whether a voltage level of the first-contact signal has changed when the plug detecting circuit is coupled to the first-contact signal input end or detect whether a voltage level of the second-contact signal has changed when the plug detecting circuit is coupled to the second-contact signal input end, and accordingly generate a plug detection signal; and a control circuit operable to determine the presence or absence of the plug in accordance with the plug detection signal.

The present invention also discloses an audio jack detection method capable of detecting the presence or absence of a plug and carried out by the audio codec of the present invention or the equivalent thereof. An embodiment of the method comprises the following steps: receiving a first-contact signal indicating the presence or absence of a sleeve contact of the plug; receiving a second-contact signal indicating the presence or absence of a ring contact or the sleeve contact of the plug; detecting whether a voltage level of the first-contact or second-contact signal has changed and thereby generating a plug detection signal; and determining the presence or absence of the plug according to the plug detection signal.

The present invention further discloses an audio codec with an audio jack detection function capable of detecting whether a plug is detached. An embodiment of the audio codec comprises: a first-contact signal input end operable to electrically connect with a sleeve contact of a plug and receive a first-contact signal; a second-contact signal input end operable to electrically connect with a ring contact or the sleeve contact of the plug and receive a second-contact signal; a bias signal output end operable to output a bias signal to the sleeve contact or the ring contact; a detachment detecting circuit operable to output the bias signal to the bias signal output end, and thereby detect an output current in response to the bias signal and generate a detachment detection signal according to the output current; and a control circuit operable to determine whether the plug is detached according to the detachment detection signal.

These and other objectives of the present invention will no doubt become obvious to those of ordinary skill in the art after reading the following detailed description of the preferred embodiments that are illustrated in the various figures and drawings.

DETAILED DESCRIPTION OF THE PREFERRED EMBODIMENTS

The following description is written by referring to terms of this invention field. If any term is defined in the specification, such term should be explained accordingly. Besides, the connection between objects or events in the disclosed embodiments can be direct or indirect provided that these embodiments are still practicable under such connection. Said "indirect" means that an intermediate object or a physical space is existed between the objects, or an intermediate event or a time interval is existed between the events.

Figure 1:
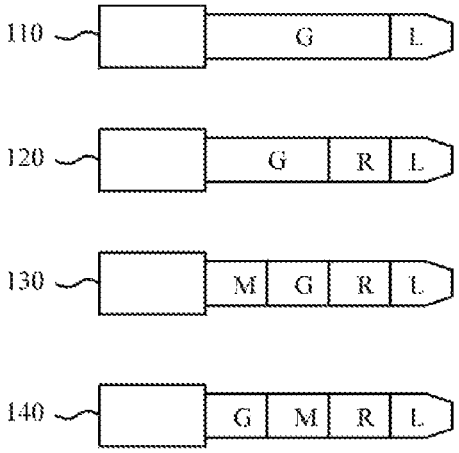
FIG. 1 illustrates the types of audio plug.

The present invention discloses an audio codec (coder/decoder) with an audio jack detection function and an audio jack detection method capable of detecting the presence or absence of an audio plug, and applicable to an integrated circuit (e.g. an audio IC) and a system device (e.g. a music player, a computer or a mobile phone). Several types of audio plug are shown in FIG. 1, comprising: a mono-channel plug 110 including a tip contact (e.g. a left-channel contact L) and a sleeve contact (e.g. a ground contact G); a dual-channel plug 120 including a tip contact (e.g. a left-channel contact L), a ring contact (e.g. a right-channel contact R) and a sleeve contact (e.g. a ground contact G); a first-type composite plug 130 supporting the functions of earphone and microphone and including a tip contact (e.g. a left-channel contact L), a ring-1 contact (e.g. a right-channel contact R), a ring-2 contact (e.g. a ground contact G) and a sleeve contact (e.g. a microphone contact M); and a second-type composite plug 140 which has the ring-2 contact and the sleeve contact swap over in comparison with the plug 130. Since the structure and function of each of the plugs 110 through 140 is known in this field, the detail thereof will be omitted if such detail has nothing or little to do with the present invention.

Figure 2:
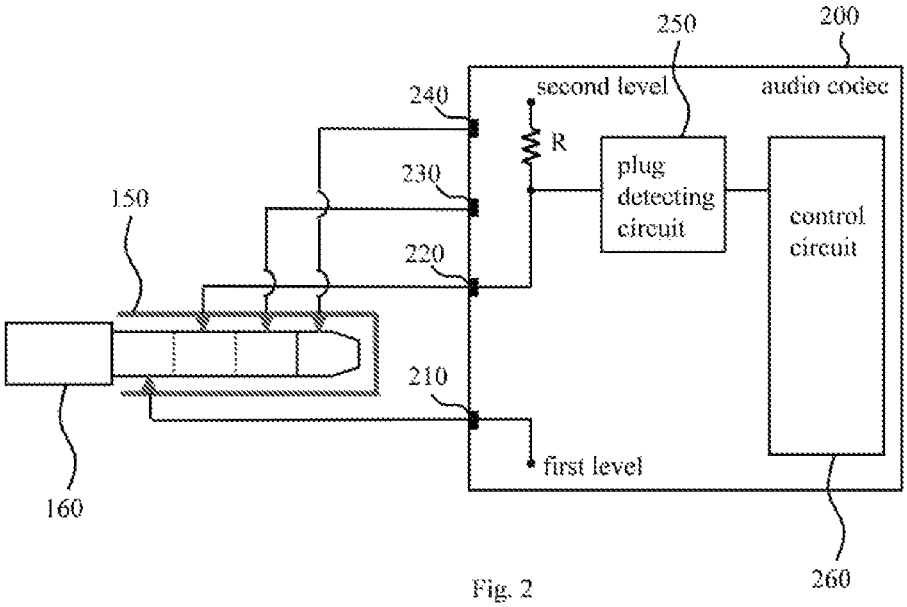
FIG. 2 illustrates an embodiment of the audio codec with an audio jack detection function of the present invention.

Please refer to FIG. 2 which illustrates an embodiment of the audio codec with an audio jack detection function of the present invention. As it is shown in FIG. 2, the audio codec 200 comprises a plurality of signal input ends, each of which is operable to electrically connect with an audio plug 160 through a jack 150; and the audio plug 160 could be any of the plugs 110 through 140 of FIG. 1. Said signal input ends comprise: a first-contact signal input end 210 operable to electrically connect with a sleeve contact of the plug 160 and receive a first-contact signal indicating the presence or absence of the plug 160; a second-contact signal input end 220 operable to electrically connect with a ring-2 contact of the plug 160 (provided that the plug 160 is in the form of the plug 130 or the plug 140 of FIG. 1) or the sleeve contact of the plug 160 (provided that the plug 160 is in the form of the plug 110 or the plug 120 of FIG. 1) and receive a second-contact signal indicating the presence or absence of the plug 160; a third-contact signal input end 230 operable to electrically connect with a ring-1 contact of the plug 160 (provided that the plug 160 is in the form of the plug 120, 130 or 140) or the sleeve contact of the plug 160 (provided that the plug 160 is in the form of the plug 110); and a fourth-contact signal input end 240 operable to electrically connect with a tip contact of the plug 160. In this embodiment the first-contact signal is a sleeve-contact signal while the second-contact signal is a ring-contact signal. The third-contact and fourth-contact signal input ends 230, 240 are normally necessary for the audio codec 200; however, since the two signal input ends 230, 240 are not relevant to the invention features, the detail description of the two ends 230, 240 is therefore omitted. Besides, the audio codec 200 further comprises: a plug detecting circuit 250 which is coupled to at least one of the first-contact and second-contact signal input ends 210, 220 and operable to detect whether a voltage level of the first-contact or second-contact signal has changed to thereby generate a plug detection signal; and a control circuit 260 (e.g. a digital signal processor or its equivalent) which is coupled to the plug detecting circuit 250 and operable to determine the presence or absence of the plug 160 in accordance with the plug detection signal.

Figure 3A:
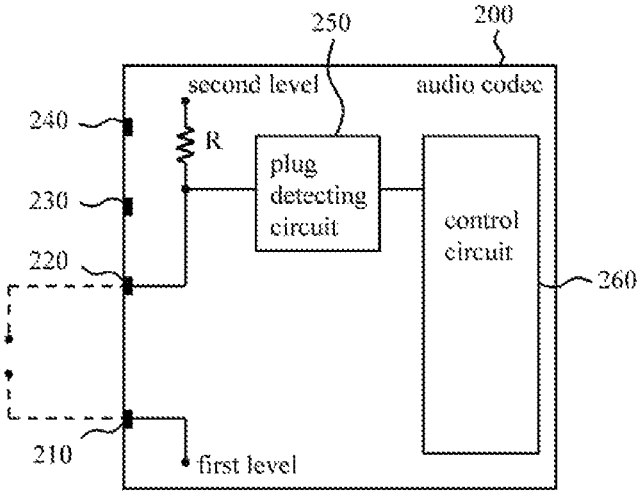
FIG. 3*a* illustrates the detection manner of FIG. 2 before a plug is inserted.
Figure 3B:
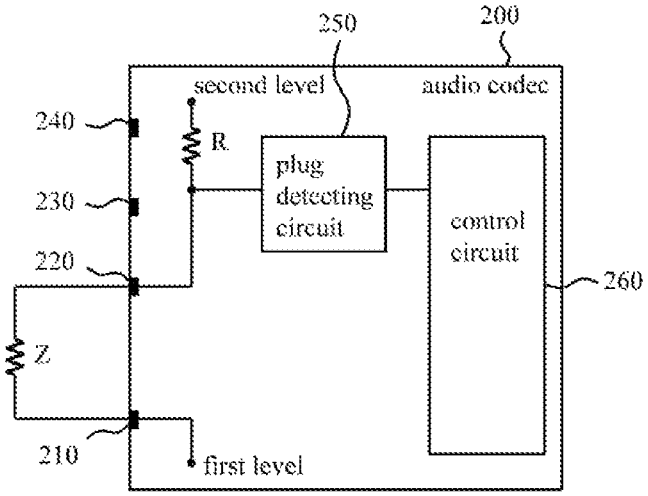
FIG. 3*b* illustrates the detection manner of FIG. 2 after a plug is inserted.

Please refer to FIG. 2 again. In this embodiment, the plug detecting circuit 250 will detect the voltage level of the second-contact signal at the second-contact signal input end 220; before the plug 160 is inserted, the voltage level at the second-contact signal input end 220 will stay by a second level (e.g. a high level $V_{DD}$) while the voltage level at the first-contact signal input end 210 will stay by a first level (e.g. a ground level $V_G$). However, people of ordinary skill in the art may rearrange the electric connection relationship between the plug detecting circuit 250 and the first-contact and second-contact signal input ends 210, 220 by referring to the disclosure of the present invention, so as to have the plug detecting circuit 250 detect the voltage level of the first-contact signal at the first-contact signal input end 210 instead of the voltage level of the second-contact signal at the second-contact signal input end 220; in this case, before the plug 160 is inserted, the voltage level at the second-contact signal input end 220 will stay by the foresaid first level (e.g. the ground level $V_G$) while the voltage level at the first-contact signal input end 210 will stay by the second level (e.g. the high level $V_{DD}$). Besides, please refer to FIG. 3*a* and FIG. 3*b*, which illustrate the detection manner of FIG. 2 before and after the plug 160 is inserted. In this embodiment, the plug detecting circuit 250 includes a comparing circuit (not shown) operable to compare the voltage level of the first-contact or second-contact signal with a predetermined level (e.g. $V_{DD}/2$). As it is shown in FIG. 3*a*, before the plug 160 is inserted, there is no conducting path lying between the first-contact signal input end 210 and the second-contact signal input end 220, so that the voltage levels of the first-contact and second-contact signal input ends 210, 220 will stay by the first level (e.g. the ground level $V_G$) and second level (e.g. the high level $V_{DD}$) respectively; meanwhile, the plug detecting circuit 250 will generate the plug detection signal by comparing the voltage level with the predetermined level and then the control circuit 260 will determine whether a plug is inserted according to the plug detection signal. On the other hand, as it is shown in FIG. 3*b*, after the plug 160 is inserted, a conducting path between the first-contact and second-contact signal input ends 210, 220 will be established due to the insertion of the plug 160; since the equivalent impedance Z of the conducting path is far less than the impedance R of the original transmission path for receiving the second level (e.g. R is a hundred or more times the impedance of Z), the voltage level of the second-contact signal input end 220 will be pulled down from the second level to some level close to the voltage level at the first-contact signal input end 210 (i.e. the first level); consequently, the plug detecting circuit 250 will generate the plug detection signal by comparing the current voltage level of the second-contact signal input end 220 with the predetermined level, and then the control circuit 260 will be able to determine the presence of the plug 160 in accordance with the plug detection signal.

In light of the above, when the audio codec 200 of the present invention is used in detecting some plug like plug 110 or plug 120 of FIG. 1, that is to say a plug without any microphone contact, the second-contact signal input end 220 could be dedicated to detecting whether a plug is inserted or detached; more specifically, the plug detecting circuit 250 will keep monitoring the presence or absence of a plug to thereby generate the plug detection signal in the aforementioned manner, and the control circuit 260 will keep determining whether a plug is inserted or removed according to the plug detection signal. In another case, when the audio codec 200 is used in detecting some plug like plug 130 or plug 140 of FIG. 1, that is to say a plug with a microphone contact, the control circuit 260 would change a stored value of a storage unit (not shown) of the audio codec 200 from a default value (indicating the absence of plug) to a reserved value (indicating the presence of plug) after the presence of plug is determined; afterwards, the control circuit 260 will no longer refer to the plug detection signal to observe the plug but determine whether the plug is detached by a detachment detection signal instead, and will change the stored value from the reserved value to the default value when the detachment of plug is found. In other words, since the plug in this case has a microphone contact, the second-contact signal input end 220 might be assigned to receiving a microphone signal after it finished the detection of plug insertion, or might be affected by a microphone signal and become inappropriate for the following detection of plug detachment, so that the control circuit 260 will refer to the detachment detection signal rather than the plug detection signal from the second-contact signal input end 220 to carry out the determination of plug detachment.

Figure 4:
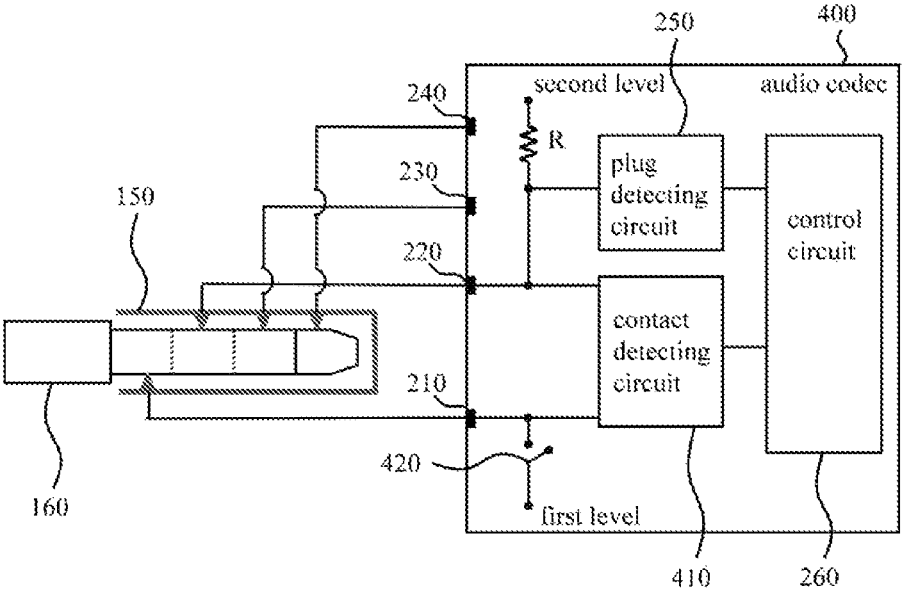
FIG. 4 illustrates another embodiment of the audio codec with an audio jack detection function of the present invention.

FIG. 4 illustrates another embodiment of the audio codec of the present invention. In order to find out whether the plug 160 has a microphone contact, the audio codec 400 of FIG. 4 in comparison with the audio codec 200 of FIG. 2 further comprises a contact detecting circuit 410 which is coupled with the first-contact and second-contact signal input ends 210, 220 and operable to generate a contact detection signal according to the first-contact and second-contact signals after the plug detection signal indicated the presence of the plug 160. In this embodiment, if the contact detection signal indicates that the first-contact and second-contact signals relate to the same signal (e.g. a ground signal), it implies that the first-contact and second-contact signal input ends 210, 220 electrically connect to the same contact (i.e. the sleeve contact (e.g. a ground contact)) of the plug 160 like plug 110 or 120 of FIG. 1, rather than connect to different contacts (i.e. the sleeve contact (e.g. a ground contact) and the ring-2 contact (e.g. a microphone contact)) of the plug 160 like plug 130 or 140 of FIG. 1, and therefore the control circuit 260 will determine that the plug 160 supports no microphone function according to the contact detection signal and keep monitoring whether the plug 160 is detached by the plug detection signal. However, if the contact detection signal indicates that the first-contact and second-contact signals relate to different signals, it implies that the first-contact and second-contact signal input ends 210, 220 electrically connect to different contacts (e.g. a microphone contact and a ground contact) of the plug 160 like plug 130 or 140 of FIG. 1; meanwhile, the control circuit 260 will be aware of the plug 160 in support of a microphone function according to the contact detection signal and therefore monitor whether the plug 160 is detached by the detachment detection signal instead. Please note that the contact detecting circuit 410 could be carried out by any appropriate plug detection technique known in this field. Please also note that when the contact detecting circuit 410 performs detection, the connection between the first-contact signal input end 210 and the foresaid first level should be broken off by a switch 420 to thereby prevent the detection from the influence of the first level as it is shown in FIG. 4, wherein the switch 420 could be controlled by the control circuit 260 or its equivalent.

Figure 5:
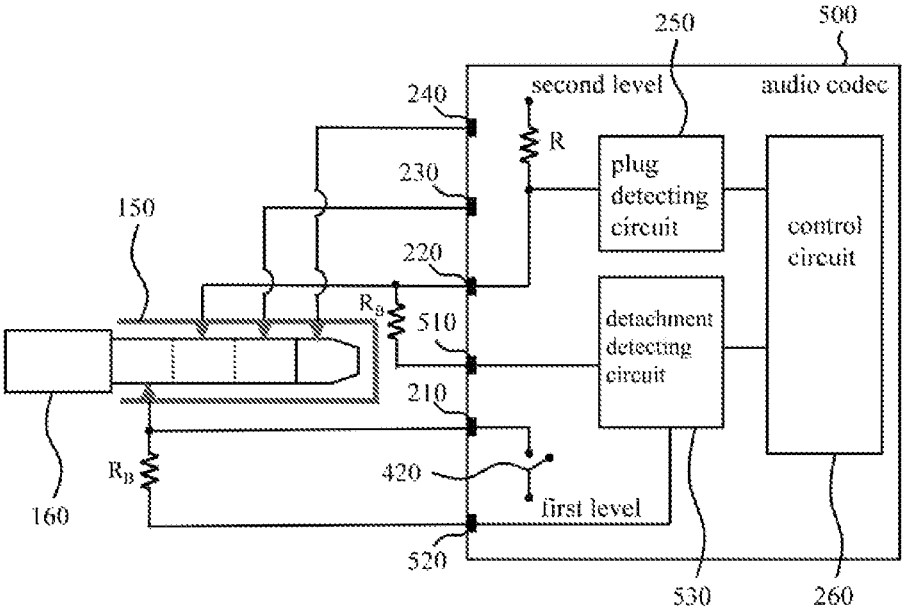
FIG. 5 illustrates a further embodiment of the audio codec with an audio jack detection function of the present invention.

Please refer to FIG. 5. In order to generate the aforementioned detachment detection signal, the audio codec 500 of FIG. 5 in comparison with the audio codec 200 of FIG. 2 further comprises: a first-bias signal output end 510 operable to output a bias signal (e.g. a microphone bias signal) to a microphone contact of the plug 160 through a bias resistance $R_B$ if the second-contact signal input end 220 is coupled with the microphone contact and treated as a microphone signal reception end; a second-bias signal output end 520 operable to output the bias signal to the microphone contact of the plug 160 through another bias resistance $R_B$ if the first-contact signal input end 210 is coupled with the microphone contact and treated as the microphone signal reception end; and a detachment detecting circuit 530 operable to output the bias signal to the first-bias or second-bias signal output ends 510, 520 under the control of the control circuit 260, then detect an output current in response to the bias signal, and accordingly generate the detachment detection signal according to the output current. For instance, the detachment detecting circuit 530 may include a parallel path (not shown), detect the current of the parallel path and thereby find out the output current based on the current flow division principle, and then generate the detachment detection signal by comparing the current value of the parallel path with a predetermined current value. Accordingly, if the detachment detection signal indicates that the current value of the parallel path has increased to be more than the predetermined current value, it implies that none of the output current is able to pass through the loop formed by the connection between the microphone and ground contacts of the plug 160 (i.e. the connection no longer exists), and thus the control circuit 260 will determine that the plug 160 has been removed. Please note that if the detachment detecting circuit 530 is found generating the detachment detection signal, it implies that the plug 160 carries the function of microphone, and therefore the control circuit 260 will determine the plug detachment according to the detachment detection signal instead of the foresaid plug detection signal. Please also note that if this detachment detecting mechanism is dedicated to detecting a plug in the form of plug 130 of FIG. 1, the first-bias signal output end 510 could be eliminated; and if this detecting mechanism is dedicated to detecting a plug in the form of plug 140 of FIG. 1, the second-bias signal output end 520 could be eliminated.

Please refer to FIG. 5 again. Since the first-contact signal input end 210 is coupled with the first level (e.g. a ground level) when executing plug insertion detection and electrically connected with the second-bias signal output end 520 when executing detachment detection, in order to prevent the detachment detection from the influence of the first level, the present embodiment sets a switch 420 between the first-contact signal input end 210 and the first level and makes it be conducting or non-conducting under the control of the control circuit 260. To be more specific; if the control circuit 260 determines the absence of the plug 160 according to the plug detection signal, it will keep or make the switch 420 conducting to carry out the plug insertion detection; but if the control circuit 260 determines the presence of the plug 160 according to the plug detection signal, it will make the switch 520 non-conducting, so as to allow the detachment detecting circuit 530 to carry out the detachment detection. Please note that as it is mentioned in the embodiment of FIG. 2, through the rearrangement of the electric connection relationship, the plug detecting circuit 250 could be coupled with the first-contact signal input end 210 instead of the second-contact input end 220 to carry out plug insertion detection, and the second-contact signal input end 220 could be coupled to the first level when executing plug insertion detection and electrically connected with the first-bias signal input end 510 when executing detachment detection; in this case, in order to prevent the detachment detection from the influence of the first level, the switch 420 or some other switch (not shown) could be disposed between the second-contact signal input end and the first level, and turned on (i.e. conducting) due to the absence of the plug 160 but turned off (i.e. non-conducting) due to the presence of the plug 160 under the control of the control circuit 260.

Please note that the embodiment of FIG. 5 may adopt the features of the embodiment of FIG. 4 to make the control circuit 260 capable of choosing the plug detection signal or the detachment detection signal as the basis of determining whether the plug 160 is removed according to the contact detection signal. In other words, if the contact detection signal indicates that the plug 160 is equipped with the function of microphone, the control circuit 260 will enable the detachment detection circuit 530 and ignore the plug detection signal or disable the plug detection circuit 250. However, if the embodiment of FIG. 5 focuses on detecting a plug with the function of microphone, the contact detection function of FIG. 4 will not be required anymore. Please also note that if the embodiments of FIG. 5 and FIG. 4 are combined, the control circuit 260 will first change the state of the switch 420 from a conducting state to a non-conducting state after the plug detection signal indicated the presence of the plug 160, so as to allow the following contact detection. Afterwards, if the contact detection signal indicates that the first-contact and second-contact signals relate to the same signal (which implies that the plug 160 carries no microphone function), the control circuit 260 will turn on the switch 420, and then determine whether the plug 160 has been detached according to the plug detection signal as the preceding paragraphs said; or if the contact detection signal indicates that the first-contact and second-contact signals relate to different signals (which implies that the plug 160 carries the function of microphone), the control circuit 260 will keep the switch 420 non-conducting, so as to determine whether the plug 160 has been removed according to the detachment detection signal. Please further note that any of the plug detection function and detachment detection function of the embodiment of FIG. 2 could be carried out independently, and the detachment detection function of the embodiment of FIG. 5 could be carried out independently as well. Since the fore-disclosed description is enough for those of ordinary skill in the art to appreciate how to carry out the plug detection or detachment detection independently, repeated and redundant explanation is therefore omitted.

Figure 6:
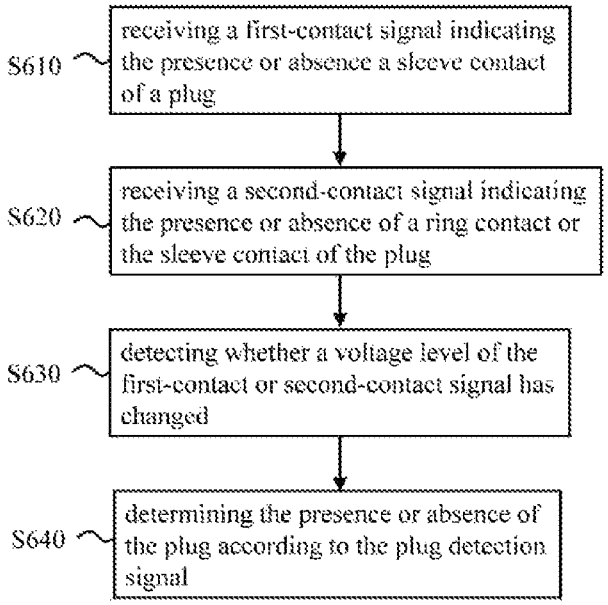
FIG. 6 illustrates an embodiment of the audio jack detection method of the present invention.

In addition to the aforementioned device invention, the present invention also discloses an audio jack detection method for detecting the presence or absence of a plug. This method could be carried out by the audio codec of the present invention or the equivalent thereof. An embodiment of the method is shown in FIG. 6, comprising the following steps:

Step S610: receiving a first-contact signal indicating the presence or absence of a sleeve contact of the plug.

Step S620: receiving a second-contact signal indicating the presence or absence of a ring contact or the sleeve contact of the plug.

Step S630: detecting whether a voltage level of the first-contact or second-contact signal has changed and thereby generating a plug detection signal. In this embodiment step S630 includes: comparing the voltage level with a predetermined level to thereby generate the plug detection signal.

Step S640: determining the presence or absence of the plug according to the plug detection signal.

Figure 7:
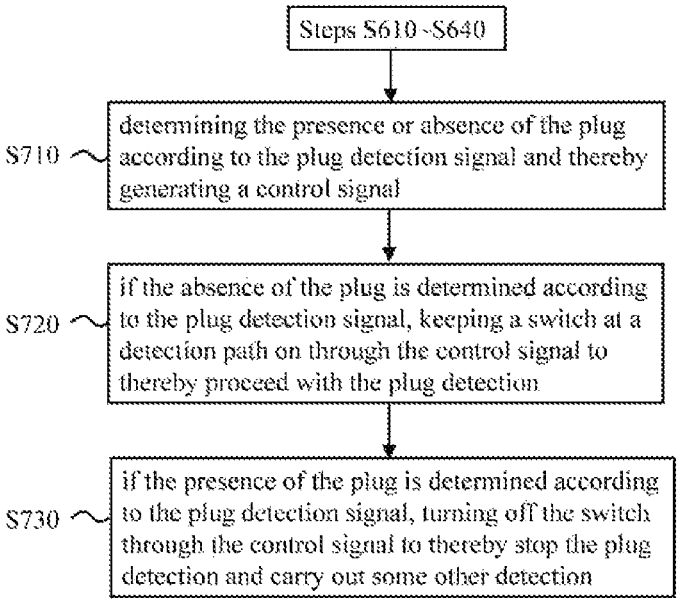
FIG. 7 illustrates an embodiment capable of deciding whether to proceed with plug detection on the basis of FIG. 6.

Please refer to FIG. 7. When the audio jack detection method of the present invention is going to detect some plug with a microphone contact (e.g. plug 130 or 140 of FIG. 1), it may further comprises the following steps in addition to those of FIG. 6:

Step S710: determining the presence or absence of the plug according to the plug detection signal and thereby generating a control signal.

Step S720: if the absence of the plug is determined according to the plug detection signal, keeping a switch at a detection path on (i.e. electrically conducting) through the control signal to thereby proceed with the plug detection of FIG. 6.

Step S730: if the presence of the plug is determined according to the plug detection signal, turning off the switch through the control signal to thereby stop the plug detection of FIG. 6 and carry out some other detection (e.g. the aforementioned contact detection and/or detachment detection).

Figure 8:
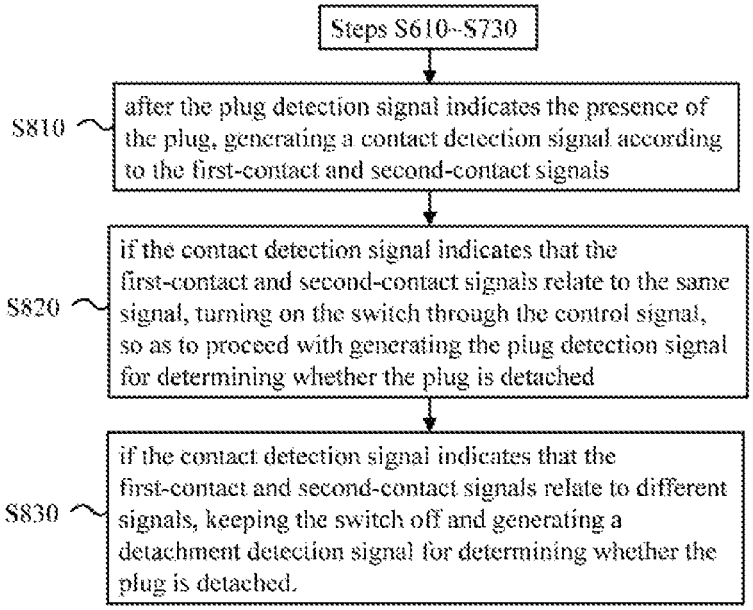
FIG. 8 illustrates an embodiment capable of executing contact detection on the basis of FIG. 7.

Furthermore, as it is shown in FIG. 8, the embodiment of FIG. 7 may further comprise the following steps to realize said contact detection:

Step S810: after the plug detection signal indicates the presence of the plug, generating a contact detection signal according to the first-contact and second-contact signals.

Step S820: if the contact detection signal indicates that the first-contact and second-contact signals relate to the same signal, which means that the concerned plug has no microphone contact, turning on the aforementioned switch through the control signal, so as to proceed with generating the plug detection signal for determining whether the plug is detached.

Step S830: if the contact detection signal indicates that the first-contact and second-contact signals relate to different signals, which means that the concerned plug has a microphone contact, keeping the switch off (i.e. electrically non-conducting) and generating a detachment detection signal in place of the plug detection signal for determining whether the plug is detached.

Figure 9:
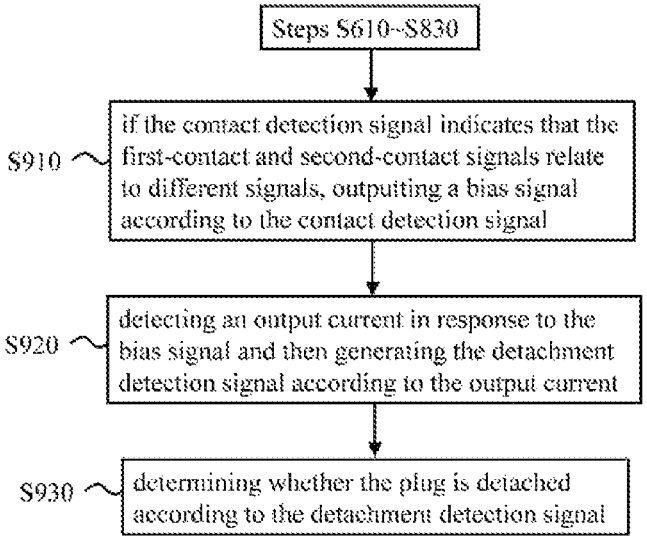
FIG. 9 illustrates an embodiment capable of generating a detachment detection signal on the basis of FIG. 8.

Please refer to FIG. 9. Under the case that the contact detection signal is used for determining whether the plug has a microphone contact, in order to generate the detachment detection signal, the embodiment of FIG. 8 may further comprises the following steps:

Step S910: if the contact detection signal indicates that the first-contact and second-contact signals relate to different signals, outputting a bias signal according to the contact detection signal.

Step S920: detecting an output current in response to the bias signal and then generating the detachment detection signal according to the output current.

Step S930: determining whether the plug is detached according to the detachment detection signal.

Figure 10:
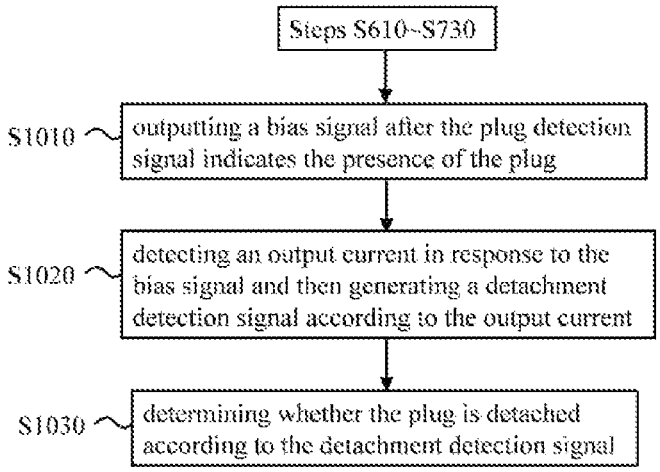
FIG. 10 illustrates an embodiment capable of generating a detachment detection signal on the basis of FIG. 7.

Besides, in consideration of another case without using the contact detection signal, the embodiment of FIG. 7 may further comprise the following steps to generate the detachment detection signal as it is shown in FIG. 10:

Step S1010: outputting a bias signal after the plug detection signal indicates the presence of the plug.

Step S1020: detecting an output current in response to the bias signal and then generating a detachment detection signal according to the output current.

Step S1030: determining whether the plug is detached according to the detachment detection signal.

In addition to the above-discussed cases, if the detection result of the presence or absence of the plug needs to be kept, the embodiment of FIG. 6 may further comprises the following steps: after the plug detection signal indicates the presence of the plug, changing a stored value from a default value to a reserved value; and determining whether to change the stored value from the reserved value to the default value according to the plug detection signal or a detachment detection signal, wherein the default value is associated with a status of plug absence and the reserved value is associated with a status of plug presence.

Since those of ordinary skill in the art can appreciate the implementation detail and modification thereto of the method invention by referring to the fore-described device invention of FIG. 2 through FIG. 5, repeated and redundant description is therefore omitted provided that the remaining disclosure is still enough for understanding and enablement. Please note that the terms such as "sleeve contact", "ring contact", "tip contact", "first level", "second level", and etc. in this specification are for identification, not for limiting the present invention. Besides, the shape, size, and ratio of any element and the step sequence of any flow chart in the disclosed figures are just exemplary for understanding, not for limiting the scope of this invention. Furthermore, each embodiment in the following description includes one or more features; however, this doesn't mean that one carrying out the present invention should make use of all the features of one embodiment at the same time, or should only carry out different embodiments separately. In other words, if an implementation derived from one or more of the embodiments is practicable, a person of ordinary skill in the art can selectively make use of some or all of the features in one embodiment or selectively make use of the combination of some or all features in several embodiments to have the implementation come true, so as to increase the flexibility of carrying out the present invention.

To sum up; the audio codec with an audio jack detection function and an audio jack detection method of the present invention carry out the insertion and/or detachment detection through the existing first-contact and second-contact signal input end, need not set some independent detecting mechanism outside the audio codec, and requires no additional pin of the audio codec to receive signals from the said independent detecting mechanism. As a result, this invention is able to consume less area of a circuit board and reduce the cost of jack detection.

The aforementioned descriptions represent merely the preferred embodiments of the present invention, without any intention to limit the scope of the present invention thereto. Various equivalent changes, alterations, or modifications based on the claims of present invention are all consequently viewed as being embraced by the scope of the present invention.

What is claimed is:

1. An audio codec with an audio jack detection function, which is operable to connect with a plug and comprises:

a first-contact signal input end operable to electrically connect with a sleeve contact of the plug and receive a first-contact signal indicating the presence or absence of the plug;

a second-contact signal input end operable to electrically connect with a ring contact or the sleeve contact of the plug and receive a second-contact signal indicating the presence or absence of the plug;

a plug detecting circuit operable to detect whether a voltage level of the first-contact signal has changed when the plug detecting circuit is coupled to the first-contact signal input end, or detect whether a voltage level of the second-contact signal has changed when the plug detecting circuit is coupled to the second-contact signal input end, and accordingly generate a plug detection signal;

a control circuit operable to determine the presence or absence of the plug in accordance with the plug detection signal; and a switch coupled between the second-contact signal input end and a ground level if the plug detecting circuit generates the plug detection signal according to the first-contact signal, or coupled between the first-contact signal input end and the ground level if the plug detecting circuit generates the plug detection signal according to the second-contact signal, wherein if the control circuit determines the absence of the plug, the control circuit keeps the switch on; and if the control circuit determines the presence of the plug, the control circuit turns off the switch.

2. The audio codec of claim 1, wherein the plug detecting circuit is a comparing circuit operable to compare the voltage level of the first-contact or second-contact signal with a predetermined level and thereby generate the plug detection signal.

3. The audio codec of claim 1, further comprising:

a contact detecting circuit operable to generate a contact detection signal according to the first-contact and second-contact signals after the plug detection signal indicates the presence of the plug, wherein if the contact detection signal indicates that the first-contact and second-contact signals relate to the same signal, the control circuit determines whether the plug is detached according to the plug detection signal.

4. The audio codec of claim 3, further comprising:

a first-bias signal output end operable to electrically connect to the sleeve contact or ring contact of the plug;

a second-bias signal output end operable to electrically connect to the sleeve contact of the plug; and a detachment detecting circuit operable to output a bias signal to the first-bias or second-bias signal output end if the contact detection signal indicates that the first-contact and second-contact signals relate to different signals, and thereby detect an output current in response to the bias signal and then generate a detachment detection signal according to the output current, wherein if the detachment detecting circuit is found generating the detachment detection signal, the control circuit determines whether the plug is detached according to the detachment detection signal.

5. The audio codec of claim 1, further comprising:

a bias signal output end operable to output a bias signal; and a detachment detecting circuit operable to output the bias signal to the bias signal output end after the plug detection signal indicates the presence of the plug, and thereby detect an output current in response to the bias signal and then generate a detachment detection signal according to the output current, wherein the control circuit determines whether the plug is detached according to the detachment detection signal.

6. The audio codec of claim 1, further comprising:

a contact detecting circuit operable to generate a contact detection signal according to the first-contact and second-contact signals after the plug detection signal indicates the presence of the plug, wherein if the contact detection signal indicates that the first-contact and second-contact signals relate to the same signal, the control circuit turns on the switch according to the contact detection signal; and if the contact detection signal indicates that the first-contact and second-contact signals relate to different signals, the control circuit keeps the switch off according to the contact detection signal.

7. The audio codec of claim 1, further comprising a storage unit while the control circuit changes a stored value of the storage unit from a default value to a reserved value after the plug detection signal indicates the presence of the plug and then determines whether to change the stored value from the reserved value to the default value according to the plug detection signal or a detachment detection signal, wherein the default value is associated with a status of plug absence and the reserved value is associated with a status of plug presence.

8. An audio jack detection method capable of detecting the presence or absence of a plug and carried out by an audio codec with an audio jack detection function, comprising:

receiving a first-contact signal indicating the presence or absence of a sleeve contact of the plug;

receiving a second-contact signal indicating the presence or absence of a ring contact or the sleeve contact of the plug;

detecting whether a voltage level of the first-contact or second-contact signal has changed and thereby generating a plug detection signal;

determining the presence or absence of the plug according to the plug detection signal and thereby generating a control signal;

if the absence of the plug is determined according to the plug detection signal, keeping a switch on through the control signal; and if the presence of the plug is determined according to the plug detection signal, turning off the switch through the control signal;

wherein the switch is coupled between a second-contact signal input end, which receives the second-contact signal, and a ground level or between a first contact-signal input end, which receives the first-contact signal, and the ground level.

9. The audio jack detection method of claim 8, wherein the step of generating the plug detection signal includes:

comparing the voltage level with a predetermined level and accordingly generating the plug detection signal.

10. The audio jack detection method of claim 8, further comprising:

after the plug detection signal indicates the presence of the plug, generating a contact detection signal according to the first-contact and second-contact signals;

if the contact detection signal indicates that the first-contact and second-contact signals relate to the same signal, turning on the switch through the control signal; and if the contact detection signal indicates that the first-contact and second-contact signals relate to different signals, keeping the switch off.

11. The audio jack detection method of claim 8, further comprising:

after the plug detection signal indicates the presence of the plug, generating a contact detection signal according to the first-contact and second-contact signals; and if the contact detection signal indicates that the first-contact and second-contact signals relate to the same signal, determining whether the plug is detached according to the plug detection signal.

12. The audio jack detection method of claim 11, further comprising:

if the contact detection signal indicates that the first-contact and second-contact signals relate to different signals, outputting a bias signal according to the contact detection signal;

detecting an output current in response to the bias signal and then generating a detachment detection signal according to the output current; and determining whether the plug is detached according to the detachment detection signal.

13. The audio jack detection method of claim 8, further comprising:

outputting a bias signal after the plug detection signal indicates the presence of the plug;

detecting an output current in response to the bias signal and then generating a detachment detection signal according to the output current; and determining whether the plug is detached according to the detachment detection signal.

14. The audio jack detection method of claim 8, further comprising:

after the plug detection signal indicates the presence of the plug, changing a stored value from a default value to a reserved value; and determining whether to change the stored value from the reserved value to the default value according to the plug detection signal or a detachment detection signal, wherein the default value is associated with a status of plug absence and the reserved value is associated with a status of plug presence.

15. An audio codec with an audio jack detection function, comprising:

a first-contact signal input end operable to electrically connect with a sleeve contact of a plug and receive a first-contact signal;

a second-contact signal input end operable to electrically connect with a ring contact or the sleeve contact of the plug and receive a second-contact signal;

a bias signal output end operable to output a bias signal to the sleeve contact or the ring contact;

a detachment detecting circuit operable to output the bias signal to the bias signal output end, and thereby detect an output current in response to the bias signal and generate a detachment detection signal according to the output current;

a control circuit operable to determine whether the plug is detached according to the detachment detection signal; and a switch coupled between one of the first-contact and second-contact signal input ends and a ground level, wherein if the control circuit determines the absence of the plug, the control circuit keeps or makes the switch conducting, and if the control circuit determines the presence of the plug, the control circuit makes the switch non-conducting.

16. The audio codec of claim 15, wherein the detachment detecting circuit compares the value of the output current with a predetermined current value and thus generates the detachment detection signal.

* * * * *